United States Patent [19]

Shimizu et al.

[11] Patent Number: 4,519,310

[45] Date of Patent: May 28, 1985

[54] METHOD OF MULTI-COLOR PRINTING ON CYLINDRICAL CONTAINER

[75] Inventors: Hiromichi Shimizu; Akira Kuboshima, both of Sagamihara; Tadashi Tanaka, Yokohama, all of Japan

[73] Assignee: Daiwa Can Company, Limited, Tokyo, Japan

[21] Appl. No.: 531,630

[22] Filed: Sep. 14, 1983

Related U.S. Application Data

[63] Continuation of Ser. No. 258,017, Apr. 27, 1981, abandoned.

[51] Int. Cl.[3] ..... B41F 17/00

[52] U.S. Cl. ..... 101/35; 101/38 R; 101/40

[58] Field of Search ..... 101/40, 38 R

[56] References Cited

U.S. PATENT DOCUMENTS

| | | | |
|---|---|---|---|
| 958,484 | 5/1910 | Evans et al. | 101/137 |
| 2,764,933 | 10/1956 | Hargrave | 101/38 R |
| 3,613,571 | 10/1971 | Russell et al. | 101/40 |
| 3,915,087 | 10/1975 | Tiemann | 101/38 R |
| 4,142,462 | 3/1979 | Gilgore | 101/38 R |
| 4,327,637 | 5/1982 | Fujimori | 101/40 |

*Primary Examiner*—Robert A. Hafer
*Assistant Examiner*—Bradley M. Lewis
*Attorney, Agent, or Firm*—George J. Brandt, Jr.

[57] ABSTRACT

The layers of ink formulations of different colors are transferred from a plurality of ink ductors onto predetermined areas of the outer periphery of a single ink form roller, and the body of a cylindrical container is pressed against said ink form roller and rotated as many times as the number of said ink ductors.

1 Claim, 5 Drawing Figures

METHOD OF MULTI-COLOR PRINTING ON CYLINDRICAL CONTAINER

BACKGROUND OF THE INVENTION

This invention relates to a method of multi-color printing (including multi-layer printing) on the exterior surface of the side wall of a cylindrical container with ink form rollers and is a continuation of application Ser. No. 258,017, filed Apr. 27, 1981, now abandoned.

It is known to perform multi-color printing on the exterior surface of the side wall of cylindrical containers such as plastic tubes and cans, and many containers with multi-color patterns printed thereon are available on the market. In one type of multi-color printing, different colors of ink are applied to a container without overlapping each other, and in the other type, different colors of ink are applied to the container so that they partially overlap. A can treated with the former type of printing is schematically shown in FIG. 1 wherein the side wall bearing a printed pattern is shown in a flat form. In FIG. 1, the side wall is painted with white paint U which is dried and baked to form a base-coat which is then printed with red (W), green (X), yellow (Y) and blue (Z) inks to form completely discrete areas. The latter type of multi-color printing is schematically represented in FIG. 2 wherein the side wall bearing a printed pattern is also shown in a flat form. In FIG. 2, the side wall has a base layer coated with white paint U', and red, green, yellow and blue areas formed by the respective colors of ink W', X', Y' and Z'. FIG. 3 is a cross section of FIG. 2 taken at the line III—III, and as shown, part of the area formed by W' is covered with X', and part of X' is covered with Y', and part of Y' is covered with Z'. Each of the overlapped portions has the tone of the color of the upper layer, with a tint of the color of the layer underneath.

The first type of multi-color printing, or printing without forming overlapped layers, is generally performed with a four-color printing machine. A typical example of the known four-color printing machine is shown schematically in FIG. 4. In the figure, a printing table is indicated generally at 1. This table supports a rotary disc 2 for transport of cans, and the disc rotates about a shaft 4. A container (A), typically a can, passes through a supply channel 6 and is fitted on a mandrel 10 mounted on the disc 2. The can is transported to a printing site 11 by the rotation of the disc 2. An ink form roller is generally indicated at 3, and it rotates about a shaft 5 in a direction opposite to that of the rotation of the disc 2. At the printing site 11, different colors of ink that have been transferred from four ink ductors 20*d*, 20*c*, 20*b*, and 20*a* are retransferred onto the exterior surface of the can A. Respective ink formulations are supplied to these ductors from known ink fountains 21*d*, 21*c*, 21*b* and 21*a*. Overprint varnish is applied to the printed surface of the can with an application roller 7. The varnish is supplied from a pair of varnish retaining rollers 8. The can with four colors of ink printed thereon and finished with varnish is subsequently discharged through a discharge channel 9. The can A on the mandrel 10 is transported to the printing site 11 by the rotation of the disc 2, and on that site, it makes rolling- and press-contact with the ink form roller 3 to have the ink on the outer circumference of the roller transferred onto the exterior surface of the can.

The embodiment shown in FIG. 2 assumes that the form roller 3 rotates counterclockwise, so the transfer of ink onto the form roller 3 starts with a rolling contact of the roller 3 with the ink ductor 20*d* which supplies a predetermined color of ink on a predetermined area of a given section. By reference to FIG. 1, for example, red ink W is supplied in a rectangular area of the section of the side wall coated with white paint U. Subsequently, a second ink formulation (say, green ink X) is supplied from the roller 20*c* onto an area of the same section which does not overlap the area of red ink, and a third ink formulation (say, yellow ink Y) is supplied from the roller 20*b* onto an area that does not overlap either of the areas formed by red and green ink formulations, and finally a fourth ink formulation (blue ink Z) is supplied from the roller 20*a* onto an area that does not overlap with any of the areas formed by red, green and yellow ink formulations. The ink form roller 3 having four colors of ink supplied in predetermined areas within a given section without overlapping each other is press-contacted by the exterior white painted surface of the can at the printing site 11, and when the can makes one turn, the four colors of ink are transferred onto the exterior surface of the can in a pattern as illustrated by FIG. 1. Subsequently, the can is coated with overprint varnish and transported through the discharge channel 9 into drying and baking zones.

One defect of the printing machine described above is that it is not capable of performing multi-color printing wherein different colors of ink are applied to form overlapping layers. As will be described in detail hereunder, overlapping layers of ink can be formed on the form roll when the tack value of ink decreases from the base layer to the top layer. This means the topmost layer made of ink having the lowest tack value is in contact with the exterior surface of the can. When the can comes out of contact with the form roll, half the thickness of the topmost ink layer is transferred onto the can, leaving the other half of the topmost layer and the underlying layers of ink on the roller.

The conventional method of multi-layer printing the result of which is schematically illustrated in FIG. 2 uses one form roller for one color. A certain color of ink is first transferred onto the exterior surface of a can, and after drying the resulting ink layer, another color of ink is applied onto an area that overlaps the area coated previously, and after drying the second ink layer, still another color of ink is applied in a like manner, followed by drying. This way, applications and dryings are repeated until a desired number of overlapping ink layers are formed. This method can achieve both types of multi-color printing, but since it involves repeated applications and dryings of ink layers, the number of process steps is increased and the process time prolonged.

Among the recently developed printing methods is the wet-on-wet method wherein a wet layer of one paint is overlaid with a layer of another paint and both layers are dried and baked simultaneously. When this method is performed with the conventional four-color printing machine described above, ink formulations can be transferred onto the form roller from the respective ink ductors, but when the ink formulations are transferred onto the exterior surface of the can, only the topmost ink layer is picked up by the can and the underlying ink layers are left on the form roller, and as a result, the desired multi-color printing cannot be acheived.

SUMMARY OF THE INVENTION

Therefore, one object of this invention is to provide a simple method of achieving multi-color printing by forming overlapping ink layers without experiencing the defects of the conventional technique.

Another object of this invention is to provide a method of multi-color printing that is also capable of forming discrete patterns of different colors.

These objects can be achieved by a method of performing multi-color printing on the side wall of a cylindrical container in transport by bringing the exterior surface of the container into a press- and rolling-contact relationship with the ink form roller, wherein a first ink formulation is transferred from a first ink ductor onto a first area of the outer periphery of said ink form roller which extends in a circumferential direction of said outer periphery and whose length is equal to the length of the outer periphery of the side wall of the container, a second ink formulation of a color different than that of the first ink formulation being transferred from a second ink ductor onto a second area of the outer periphery of said ink form roller whose length is equal to that of the first area and which is adjacent to said first area and extends in a circumferential direction of said outer periphery, two or more ink formulations of different colors being sequentially transferred in a like manner from two or more ink ductors onto the outer periphery of the ink form roller, the exterior surface of the side wall of said container being brought into a press- and rolling-contact relationship with the ink form roller having the layers of the desired ink formulations transferred thereto, said container being rotated as many times as the number of the ink ductors so that the respective ink layers are transferred onto the exterior surface of the side wall of said container from said ink form roller.

DETAILED DESCRIPTION OF PREFERRED EMBODIMENTS

Figure 4:
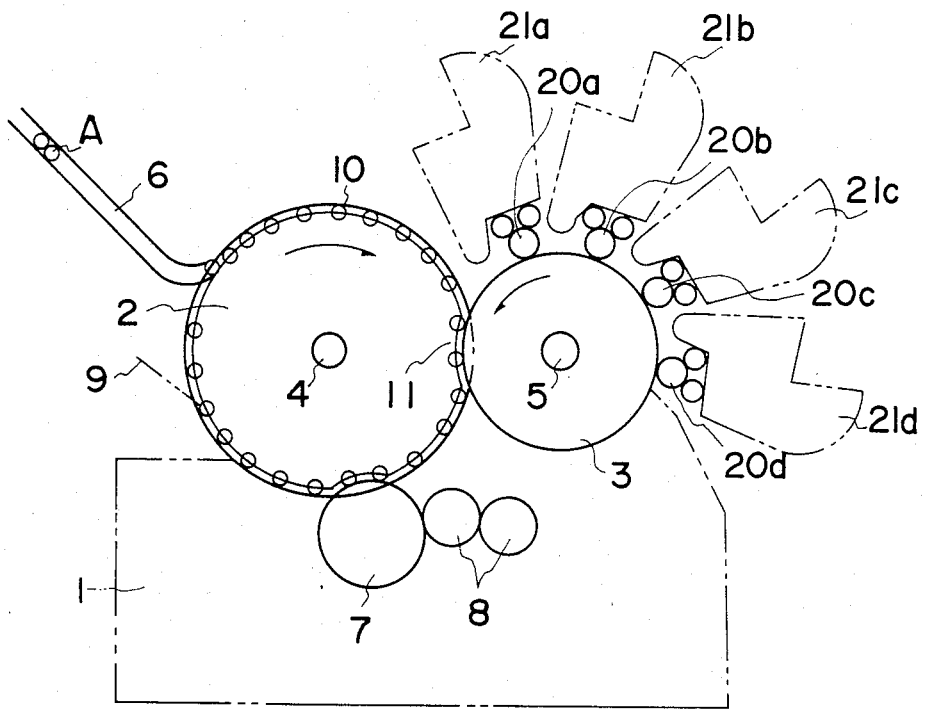
FIG. 4 is a schematic line drawing of essential parts of the conventional four-color printing machine.
Figure 5:
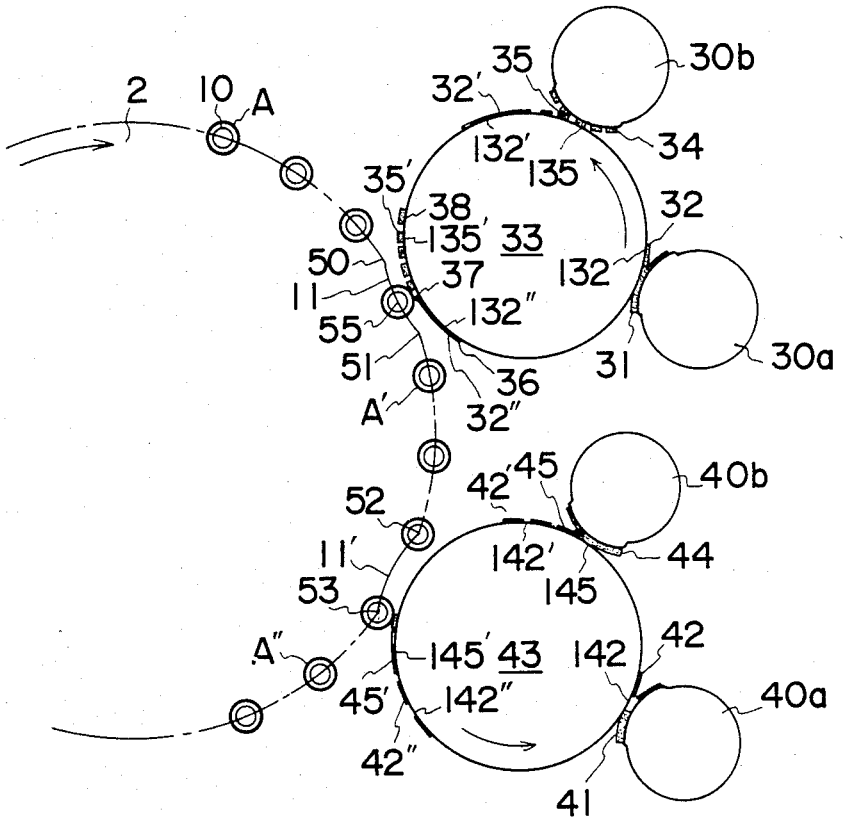
FIG. 5 is a schematic line drawing showing one embodiment of the method of this invention.

One embodiment of the method of this invention is now described by reference to FIG. 5. In the figure, a rotary disc that has a can A supplied through a can supply channel (not shown) and fitted on a mandrel 10 is generally indicated at 2 as in FIG. 4, and upper and lower form rollers 33, 43 are positioned adjacent to the rotary disc 2. In the figure, 11 is an upper printing section where the can A on the mandrel 10 receives ink from the upper ink form roller 33 as it is advanced (revolved about the axis of the disc 2) by the rotation of the disc 2; 11' is a lower printing section wherein the can likewise receives ink from the lower ink form roller 34; **30*a* is a first ink ductor which transfers a first ink formulation onto the upper from roller 33; 30*b* is a second ink ductor for transfer of a second ink formulation; 31 is a first ink layer deposited on the first ink ductor 30*a*; 32 is a first layer that has been transferred from said first ink ductor 30*a* onto a first area 132 of the ink form roller 33. Said first area 132 is that part of the outer periphery of the ink form roller 33 which extends in circumferential direction of the roller 33 and whose length is equal to that of the outer periphery of the side wall of the can, and the first layer deposited on the first ink ductor 30*a* is transferred onto this first area 132**. Generally, when two rollers holding ink in position and rotating at equal speeds come out of engagement, an ink layer about the same thickness is left on each roller.

When the form roller 33 continues to rotate and the first area 132 has passed under the second ink ductor **30*b* to reach an area indicated by 132', a second ink layer 34 deposited on said ductor 30*b* is transferred onto a second area 135 of the roller 33. The second ink layer thus transferred is indicated at 35. The second area 135 is adjacent and equal in length to said first area that has been brought to the area 132' by the rotation of the ink form roller 33 and extends in a circumferential direction of said roller. Each of the length of the two areas 132, 135 is equal to the length of the outer periphery of the side wall of the can that is indicated by l in FIG. 2**.

The two areas 132, 135 having the ink formulations transferred thereto advance further until they come into a press-contact-relationship at a point 50 on the pass line of the can with the can A that has been transported on the rotary disc 2. The point 50 is also the starting point of the upper printing section 11. When the center of the can A reaches this point, the leading edge of the first area 132 having the ink layer 32 transferred onto the first area 132 on the form roller 33 comes into contact with the exterior surface of the side wall of the can A. The can A, while it remains in press-contact relationship with the roller 33, continues to revolve about the axis of the disc 2 until it reaches a point 55 intermediate of the starting point 50 and a point 51 where it is no longer in press-contact with the roller 33, and at this point 55, the can stops being in press-contact relationship with the first area 132 which is equal in length to the outer periphery of the side wall of the can. At the same time, the can starts to make press-contact with the leading edge of the second area 135 (which is also the trailing edge of the first area 132). Therefore, when the can A moves from the starting point 50 to the intermediate point 55, the upper ink form roller 33 rotates from a position where the leading edge 36 of the first area 132 faces the starting point 50 (i.e. a point where the line connecting the starting point 50 and the center of the upper ink from rolling crosses the circle formed by the outer periphery of the ink form roller) to the position indicated in FIG. 5 (the first area 132 is indicated at 132''), and in consequence, the can A is caused to make one turn so that the ink layer 32 transferred onto the first area 132 is retransferred onto the side wall of the can A. In FIG. 5, an ink layer which is left untransferred on the roller 33 is indicated at 32''. Subsequently, the can A moves from the intermediate point 55 to the ending point 51, and during this period, the second ink layer 35' transferred onto the second area 135 (which has moved to a position indicated at 135') of the upper ink form roller 33 is retransferred onto the exterior surface of the side of the can.

The above procedure is enough to achieve two-color printing. In a preferred embodiment of this invention, four-color printing is performed using a lower ink form roller 43 for printing of the other two colors. As shown in FIG. 5, the form roller 43 is positioned along a path where the can A advances and it is ahead of the upper ink form roller 33. In FIG. 5, third and fourth ink ductors are indicated at 40*a* and 40*b*, respectively. Details of the low ink form roller, and the third and fourth ink ductors are not described herein brcause they have the same construction and function as those of the upper ink form roller 33 and the first and second ink ductors 30*a* and 30*b*. In the figure, 41 and 44 are ink layers deposited on the third and fourth ink ductors 40*a* and 40*b*, respectively; and 42 and 45 are third and fourth ink layers transferred onto third and fourth areas 142 and 145 of the ink form roller 43. Like the first and second areas 132 and 135, the third and fourth areas 142 and 145 are adjacent each other and equal in length to the outer periphery of the side wall of the can. The starting point and ending point of the lower printing section 11' are indicated at 52 and 53 which correspond to the points 50 and 51, respectively. In FIG. 5, the lower ink form roller 33 is represented as if only the first ink layer has been transferred onto the side wall of the can A, and the lower ink form roller 43 is represented as if the can A' has made two turns to come out of contact with the third and fourth areas (which are indicated at 142'' and 145' in the figure).

Figure 1:
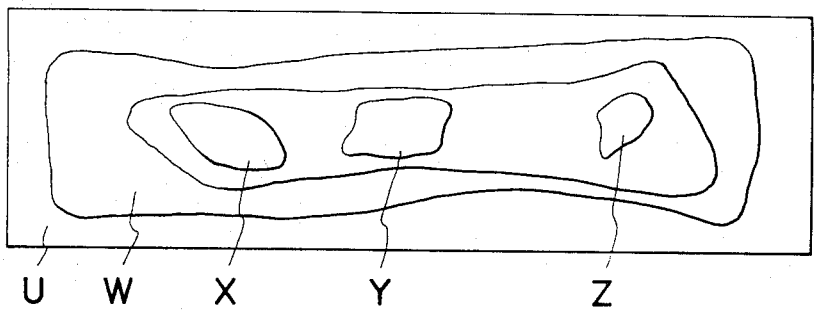
FIG. 1 is a schematic representation of the side wall of a container treated with multi-color printing to form discrete patterns of different colors, the side wall being shown in a flat form for the sake of clarity.

The can A' to which the first and second ink layers have been transferred from the upper ink form roller 33 in the upper printing section 11 continues its revolution about the axis of the disc 2, and in the lower printing section 11', the can has the third and fourth ink layers transferred onto its side wall from the lower ink form roller 43 as in the upper printing section 11. The can having the four ink layers transferred thereto is indicated at A''. Subsequently, the can continues to revolve about the axis of the disc 2 and is dislodged from the mandrel and sent to drying and baking zones through a discharge channel. The first to fourth ink layers according to the embodiment described above correspond to the inks W, X, Y and Z noted in FIG. 1.

The embodiment described above assumes the use of two ink form rollers, but it is to be understood that four-color printing can be effected with a single form roller having formed thereon four areas that correspond to the first to fourth areas 132, 135, 142 and 145. It is also to be understood that three or more form rollers may be used. A printing method wherein four colors of ink transferred onto a single ink form roller are sequentially retransferred onto the can, one color for one turn of the can, permits the use of a somewhat simple printing machine. In the embodiment described above, two colors of ink are transferred onto each one of two ink rollers, and this method has the advantage of high-speed printing as compared with the former type of four-color printing using only one ink form roller.

We now describe the method of performing four-color printing to form overlapping ink layers according to this invention. This method is possible by controlling the tack value of different ink formulations, and except for that point, the explanation of the method of four-color printing to form four discrete patterns applies, so the following description concerns only the gist of the method of performing four-color printing to form overlapping ink layers. To form overlapping ink layers wherein a first ink layer transferred onto the can is partially overlapped by a second ink layer, the first transferred ink layer must have a tack value lower than the second ink layer. One plausible reason for this necessity is as folows: as already described, when the can is rotated in a press-contact relationship with an ink form roller to have ink transferred onto the can, the thickness of the ink layer transferred is about half the initial thickness of the ink layer on the form roller. When the form roller carrying a subsequent ink layer is brought into a press-contact relationship with the can while the previously transferred ink layer is still wet, two wet ink layers are formed between the can and the form roller. When the can and form roll rotating in a rolling-contact relationship gradually come out of engagement, the ink layer having a lower tack value is separated into two. Therefore, if the ink layer first transferred onto the can body has a tack value lower than that of the ink layer transferred next, the first ink layer is separated into two, and as a result, one half of the first ink layer is left on the can body whereas the other half and all of the subsequently transferred ink layer are left on the form roller. On the other hand, if the previously transferred ink layer has a higher tack value, one half of the subsequently applied ink layer is transferred onto the previously applied ink layer to provide a can body having ink layers of different colors printed thereon.

Figure 2:
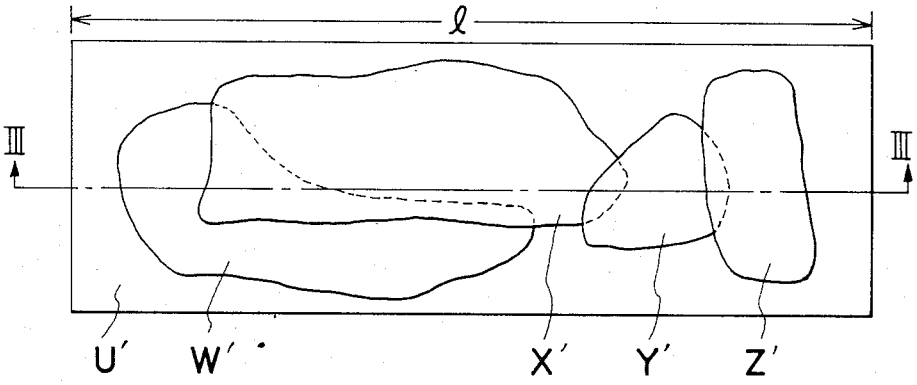
FIG. 2 is a schematic representation of the side wall of a container treated with multi-color printing to form overlapping ink layers of different colors, the side wall also being shown in a flat form for the sake of clarity.
Figure 3:
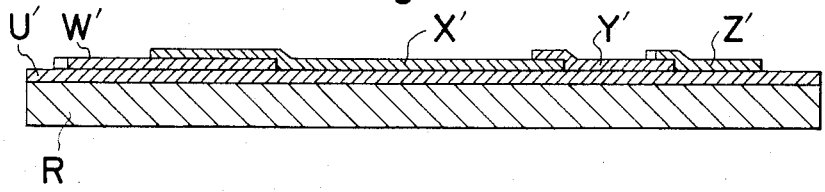
FIG. 3 is a cross section of FIG. 2 taken at the line III—III with the thickness of the respective ink layers being exaggerated.

The above embodiment is now described by reference to FIGS. 5 and 2: for instance, red ink (W') is transferred onto the first area 132 of the upper form roller 33 to provide a pattern as shown in FIG. 2, and green ink (X') having a lower tack value than W' is applied to the second area 135 in a pattern as shown in FIG. 2, and the two ink layers W' and X' are transferred onto the exterior surface of the can A in the upper printing section 11 such that the layer W' is overlapped partially with the layer X'. Yellow ink (Y') having a lower tack value than X' is transferred onto the third area 142 of the lower form roller 43 in a pattern as shown in FIG. 2, and blue ink (Z') having the lowest tack value is transferred onto the fourth area 145 in a pattern as shown in FIG. 2, and the two ink layers Y' and Z' are transferred onto the exterior surface of the can A' in the lower printing section 11' such that the layer Y' is overlapped with the layer Z'.

The tack value of the ink decreases from the first applied ink formulation to the last applied one, so that an ink formulation can be transferred onto the exterior surface of the can body to partially overlap the layer formed of the previously applied ink. Because of this, the method of this invention can be used with advantage for providing gradation in dot printing. Overlapping ink layers of different colors can be provided by usin one or more ink form rollers. High-speed printing can be achieved with more than one ink form roller.

As described in the foregoing pages, according to the method of this invention, a single ink form roller bearing one ink layer in each of a plurality of predetermined areas of the roller is brought into a rolling- and press-contact relationship with the can body to transfer an ink layer of one color onto the exterior surface of the can body per turn of the can. As a result, this invention can provide not only discrete patterns of different colors but also overlapping ink layers by decreasing the tack value of ink from the first transferred ink layer to the last transferred ink layer. As a further advantage, this invention uses only one ink form roller to transfer more than one color of ink layer and achieves a higher degree of registration than the conventional multi-color printing method for providing both discrete and overlapping patterns.

We have so far described preferred embodiments of this invention, but it should be understood that the scope of this invention is by no means limited to the foregoing description. It is also to be understood that many variations and modifications can be made without departing from the scope and spirit of the invention.

What is claimed is:

1. A method of multi-color printing the side wall of a cylindrical container in which at least some of the colors overlap others comprising, transferring a first ink formulation from a first ink ductor onto a first area of the outer periphery of a first ink form roller which first area extends in a circumferential direction of said outer periphery and the length of which is equal to the length of the outer periphery of the container side wall, transferring a second ink formulation of a color different from and of tack value lower than that of said first ink formulation from a second ink ductor onto a second area of the outer periphery of said first ink form roller, the length of said second area being to that of the first area and said second area being immediately adjacent to said first area and extending in a circumferential direction of said outer periphery, sequentially transferring third and fourth ink formulations of colors different from each other and those of said first and second ink formulations and of successively lower tack values than said second ink formulation from at least two further ink ductors onto first and second successively arranged areas of the outer periphery of a second ink form roller and which successive areas are each of length equal to those of the areas on said first ink form roller and extend in a circumferential direction of said second ink form roller outer periphery, positioning said container at a first printing station and while at said first printing station bringing said container side wall into press- and rolling-contact with the first area of said first ink form roller to transfer a layer of said first ink formulation to said container, while rotating it one revolution, bringing said container side wall while said container is still at said first printing station into press- and rolling contact with said first ink form roller second area and rotating said container one revolution while it is in contact with said second area to transfer the second ink formulation to said container side wall, moving the thus far printed container to a second printing station remote from said first station, and while at said second printing station bringing said container side wall into press- and rolling contact successively with the first and second successively arranged areas of the outer periphery of said second ink form roller while rotating said container one revolution while it is in contact with each of said last-mentioned first and second areas to transfer the respective third and fourth ink formulations to said container, whereby the inks transferred to said container side wall are applied thereto in order of descending tack value and where inks are in overlapped relationship, the overlapping ink is one having a lower tack value than the overlapped ink.

* * * * *